US005400532A

United States Patent [19]

Grove

[11] Patent Number: 5,400,532

[45] Date of Patent: Mar. 28, 1995

[54] DESK-TOP PICTURE GALLERY

[76] Inventor: John C. Grove, 3037 Pierce St., San Farncisco, Calif. 94123

[21] Appl. No.: 951,800

[22] Filed: Sep. 28, 1992

[51] Int. Cl.[6] ..... G09F 1/12

[52] U.S. Cl. ..... 40/152.1; 40/158.1

[58] Field of Search ..... 40/152, 152.1, 156, 40/158.1, 490, 491, 159, 661; 248/150, 224.4, 225.1

[56] References Cited

U.S. PATENT DOCUMENTS

| | | | |
|---|---|---|---|
| 214,105 | 4/1879 | Cole | 40/152.1 |
| 1,068,621 | 7/1913 | Abraham | 40/152 |
| 2,226,176 | 12/1940 | O'Brien | 40/159 X |
| 2,623,316 | 12/1952 | Knox | 40/152 |
| 3,557,480 | 1/1971 | Ebner . | |
| 3,680,239 | 8/1972 | Andrews | 40/152.1 |
| 3,836,104 | 9/1974 | Miller et al. | 248/150 |
| 4,691,456 | 9/1987 | Ackeret . | |
| 4,798,015 | 1/1989 | Ackeret | 40/152.1 |
| 4,981,211 | 1/1991 | Janek | 40/158.1 X |
| 5,068,987 | 12/1991 | Tontarelli | 40/152.1 |

FOREIGN PATENT DOCUMENTS

| | | | |
|---|---|---|---|
| 957497 | 11/1974 | Canada | 40/152.1 |
| 2468173 | 5/1981 | France | 40/661 |
| 1137702 | 12/1968 | United Kingdom | 248/150 |

*Primary Examiner*—Kenneth J. Dorner
*Assistant Examiner*—J. Silbermann
*Attorney, Agent, or Firm*—Michael Ebert

[57] ABSTRACT

A desk-top picture gallery adapted selectively to display any picture in a deck of photo prints all of the same size. The gallery is constituted by a frame-pocket assembly supported on a detachable easel. The box-like pocket which accommodates the deck of prints is secured to the rear of the frame behind its opening, the pocket having a front window which exposes to view whichever print then occupies the first position in the deck. The easel is provided with a step on which the pocket rests, the step having a ridge thereon which is socketed either within a complementary slot in the closed end of the pocket, in which case the assembly is then vertically oriented, or within a complementary slot in either of the two sides of the pocket, in which case the assembly is then horizontally oriented. To interchange the picture on display with another selected from the deck, the selected print is transferred to occupy the first position in the deck.

9 Claims, 3 Drawing Sheets

Fig. 1.
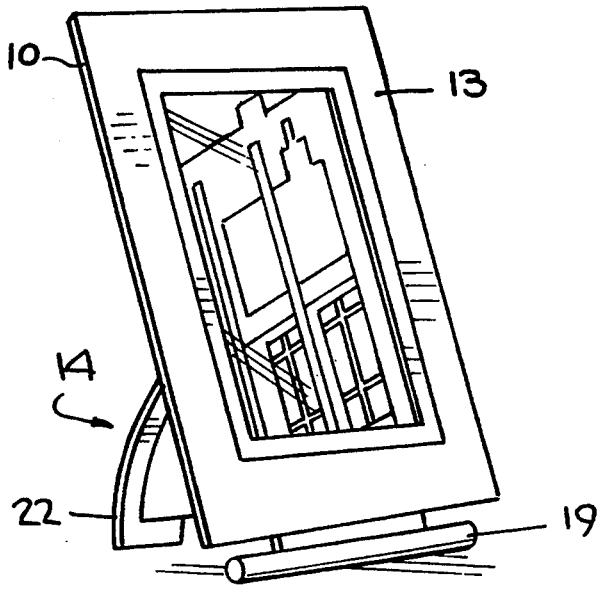
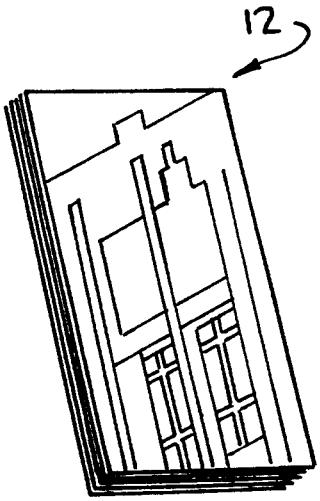
Fig. 3.
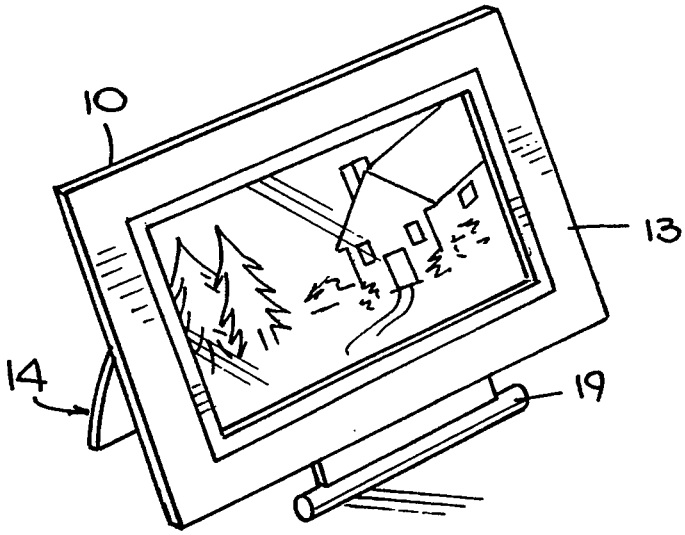
Fig. 2.
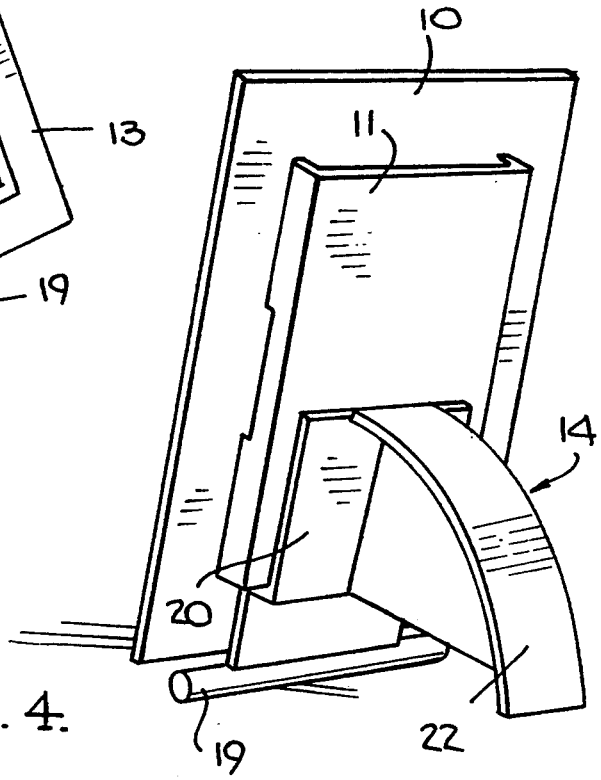
Fig. 4.

DESK-TOP PICTURE GALLERY

BACKGROUND OF INVENTION

1. Field of Invention

This invention relates generally to devices for displaying photographic prints, and more particularly to a desk-top picture gallery for selectively displaying any print in a deck of photo prints, all of the same size.

2. Status of Prior Art

A photographer's studio is sometimes referred to as a gallery, for hanging from the walls of the studio are various photographs, as in an art gallery. Within the confines of a typical home or office, it is not feasible to hang on the walls, say, an entire set of thirty-six prints obtained by exposing the 36 frames of a standard roll of film. These prints are quite small; for example, 4 by 6 inches in size, and if put on a wall, they would be difficult to see except at very close range.

It is for this reason that when a photographic print or picture that is a positive copy made from a negative, is to be displayed in an office or at home, the usual practice is to mount the print in a frame supported by a stationary or collapsible leg that may be placed on a desk or table top so that the print may readily be viewed at close range. Thus it is not uncommon for an executive to have on his desk a framed photo of his family. For this purpose, the picture frame is self-supporting. Use is not made of a separate easel adapted to hold an article at an inclined position at a proper viewing level.

There are occasions, however, where an individual has taken photographs, say, while on vacation, at a child's birthday party, or on a business trip in a foreign country, and winds up with a multitude of prints, many of which are exceptionally interesting. For instance, if the person taking the pictures is a professional architect who has photographed major historic edifices in the city of Rome and finds that about thirty of those photographs are remarkably fine and worthy of display in his office, he cannot as a practical matter mount each of these pictures in a separate frame supported by a collapsible leg, for there is no room in his office for so large a number of individual picture frames. And while he could mount these pictures in a photo album, none of these can be seen unless the album is consulted.

Another problem that arises when mounting a print in a conventional, leg-supported frame is that the pictures may have been taken vertically in order, for example, to encompass a tall structure, or the picture may have been taken horizontally to encompass a group of individuals or a panoramic view. It is necessary, therefore, to make use of two different types of leg-supported frames; one for a horizontally-oriented picture, the other for a vertically-oriented picture.

In order to selectively display any print in a deck of prints, it is known to provide a container for this purpose. Thus the Ackeret U.S. Pat. No. 4,691,456 discloses a container for accommodating a stack or deck of prints all of the same size, the container having a display window which exposes the first print in the deck. But no easel or other means is provided for this container so as to erect the print on display. However, the Ackeret U.S. Pat. No. 4,798,015 shows a similar display container in combination with a stand so that the container can then be stood up. This collapsible stand is common to many frames, whether or not they hold single or multiple items for display.

The U.S. Pat. No. to Ebner, 3,557,480, shows a photo picture holder that can be suspended from a wall or stood up, the holder having a framed front opening and a compartment to hold a stack of pictures behind this opening which can be interchanged with the picture being displayed.

The Andrews Pat. No. 3,680,239 shows a picture frame attached to a holder for a stack of interchangeable pictures. Hanger tabs are provided so that the frame can be hung vertically or horizontally.

The U.S. Pat. No. to Tontarella et al., 5,068,987 discloses a box for accommodating a stack of photo prints and having a clear plastic lid acting as a window exposing the first picture in the stack. This box is supported on a collapsible leg.

SUMMARY OF INVENTION

In view of the foregoing, the main object of this invention is to provide a desk-top picture gallery adapted selectively to display any print or picture in a deck of photo prints all of the same size, the arrangement being such that one can readily interchange the picture being displayed with another picture drawn from the deck.

More particularly, it is an object of this invention to provide a picture gallery of the above type constituted by a frame-pocket assembly in which a deck of prints is accommodated in the pocket behind the opening of the frame so as to display the first picture in the deck, the assembly being supportable on a detachable easel so that the same assembly may be oriented to display either a photo taken horizontally or one taken vertically.

A significant feature of the invention is that the frame is provided with a removable face mat that may be changed to alter the decorative appearance of the frame.

Also an object of the invention is to provide a desk-top picture gallery that may be mass-produced at a relatively low cost in dimensions appropriate to the size of the prints stored in its pocket.

Briefly stated, these objects are attained in a desk-top picture gallery adapted selectively to display any picture in a deck of photo prints all of the same size. The gallery is constituted by a frame-pocket assembly supported on a detachable easel. The box-like pocket which accommodates the deck of prints is secured to the rear of the frame behind its opening, the pocket having a front window which exposes to view whichever print then occupies the first position in the deck.

The easel is provided with a step on which the pocket rests, the step having a ridge thereon which is socketed either within a complementary slot in the closed end of the pocket, in which case the assembly is then vertically oriented, or within a complementary slot in either one of the two sides of the pocket, in which case the assembly is then horizontally oriented. To interchange the picture on display with another selected from the deck, the selected print is transferred to occupy the first position in the deck.

BRIEF DESCRIPTION OF DRAWINGS

For a better understanding of the invention as well as other objects and further features therein, reference is made to the following detailed description to be read in conjunction with the accompanying drawings, wherein:

FIG. 1 is a perspective view of a desk-top picture gallery in accordance with the invention in its vertical-orientation mode, as seen from the front;

FIG. 2 shows the same gallery in its horizontal-orientation mode;

FIG. 3 separately shows the deck of photo prints which is stored in the pocket or cartridge of the gallery;

FIG. 4 is a perspective view of the gallery in the vertical-orientation mode, as seen from the rear;

DESCRIPTION OF INVENTION

Figure 5:
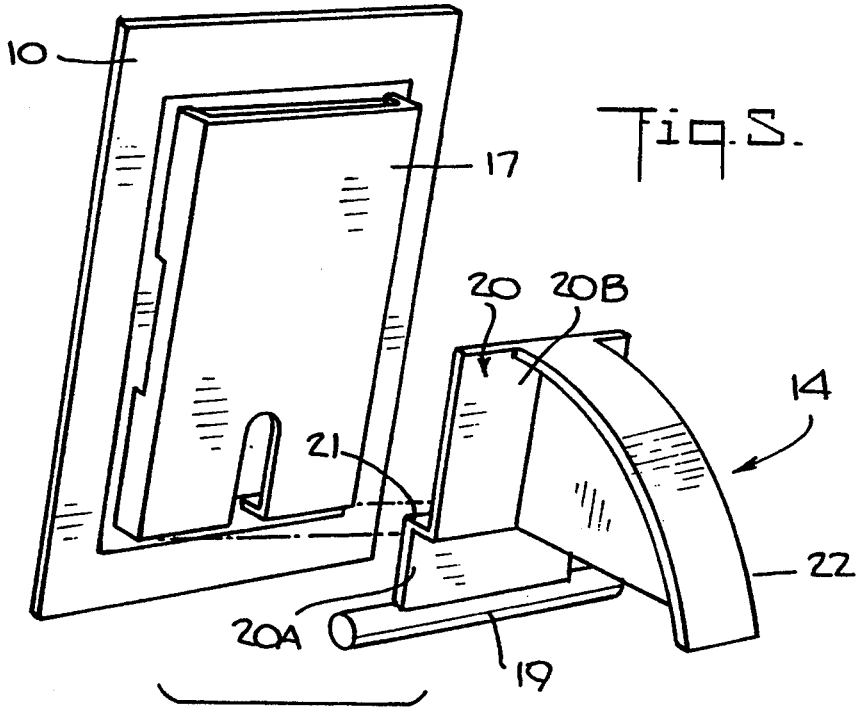
FIG. 5 is a rear view showing the frame pocket assembly separated from the easel.

The main components of a desk-type picture gallery in accordance with the invention are a planar frame 10 having a rectangular opening whose dimensions substantially match those of the print to be displayed, a box-like cartridge or pocket, generally designated by numeral 11, for accommodating a deck of prints 12 (shown separately in FIG. 3), a planar rectangular face mat 13 attachable to the front of frame 10 to impart decorative effects thereto, and an easel, generally designated by numeral 14.

Frame 10 together with pocket 11 form a frame-pocket assembly which is so supported on easel 14 that the assembly is either vertically-oriented, as shown in FIG. 1, or horizontally-oriented, as shown in FIG. 2, depending on the orientation of the print then on display. If, therefore, one changes the print on display from one that is vertically-oriented to one horizontally-oriented, one must then change the posture of the frame-pocket assembly on easel 14.

Figure 6:
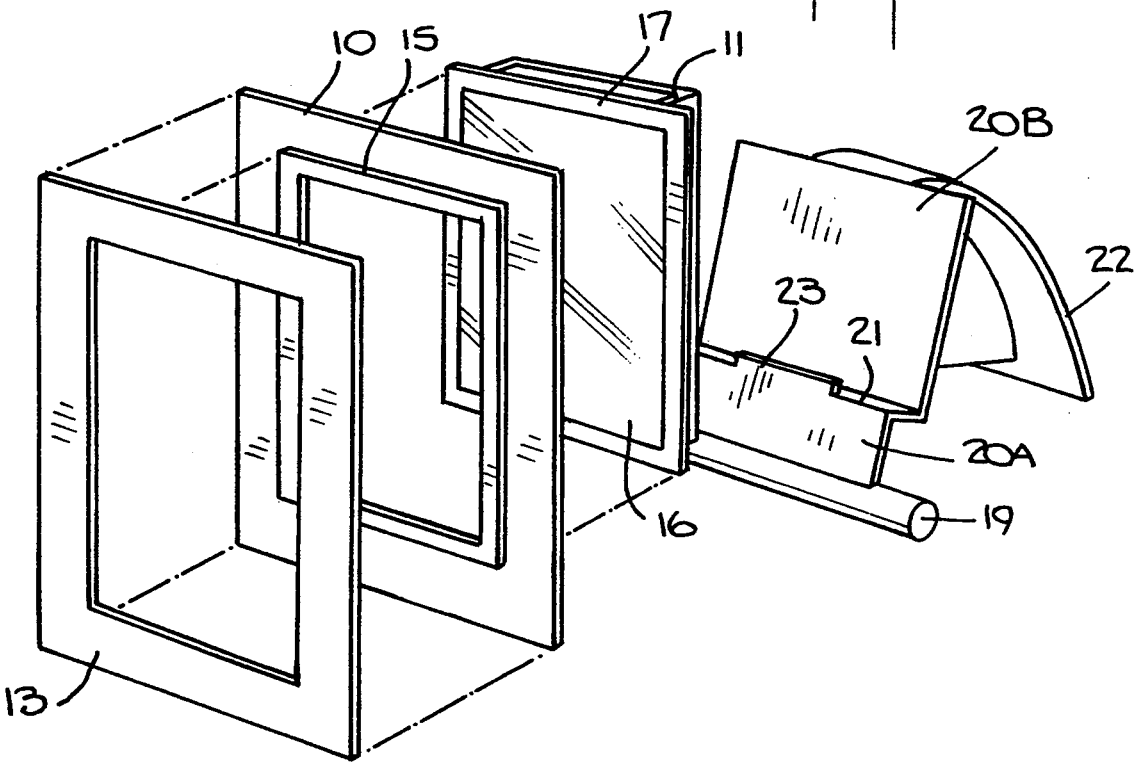
FIG. 6 is an exploded view of the gallery.
Figure 10:
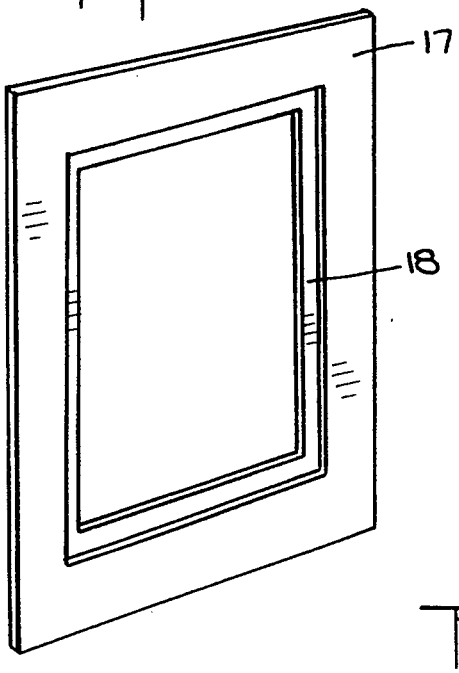
FIG. 10 shows the rear of the frame.
Figure 11:
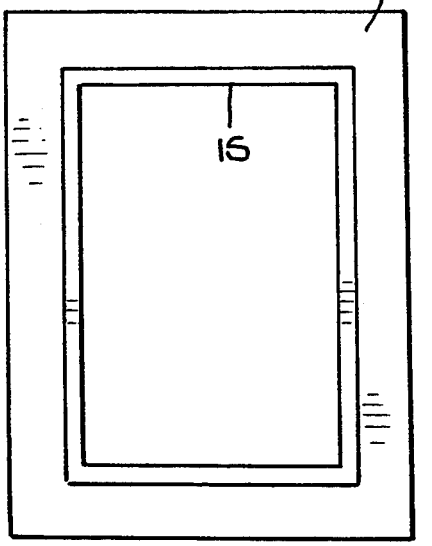
FIG. 11 shows the front of the frame without the mat.
Figure 12:
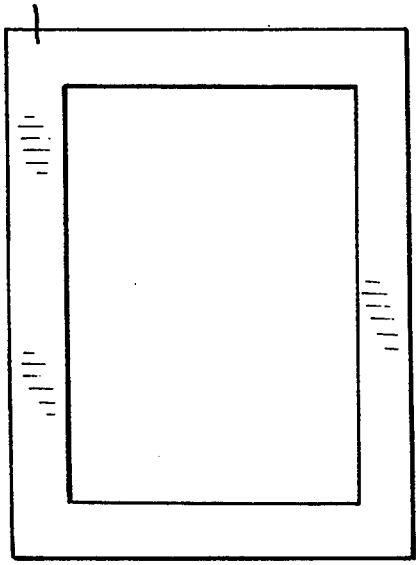
FIG. 12 separately shows the mat.

As shown in FIGS. 6 and 11, frame 10 is provided on its front face with a raised inner border 15 surrounding the opening, the outer dimensions of the border matching those of the rectangular opening in mat 13, the border having the same thickness as the mat. Hence mat 13 fits snugly onto raised border 15 and lies flat against the front surface of the frame. In practice, mats of different color and patterns, or having textured or metallized surfaces may be provided so that the user of the picture gallery can alter the appearance of the frame to conform to the decor of the room in which the gallery is placed.

Figure 7:
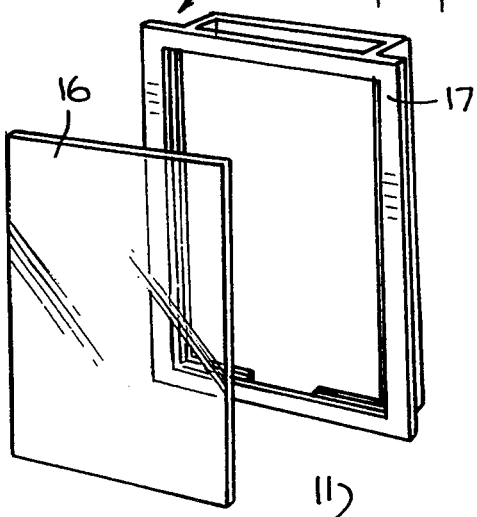
FIG. 7 is a front perspective view of the pocket with the window separated therefrom.

Pocket 11, as best seen in FIGS. 6 and 7, is provided with a front window 16 set within a rectangular flange 17 whose dimensions are such that flange 17 fits snugly within a recessed border 18 in the rear side of frame 10 surrounding the rectangular opening therein. In this way, the pocket is joined to the frame to form the frame-pocket assembly. In practice, the pocket may be epoxy bonded to the frame, but the mat must remain separable from the frame.

Easel 14, as best seen in FIGS. 4 to 6, is provided with a horizontal foot rod 19 on which is anchored the lower end of a back plate 20 having a step 21 therein, thereby defining a lower plate section 20A and an upper plate section 20B.

Secured to the rear of upper plate section 20B is an arcuate leg 22, such that when the foot rod 19 and leg 22 rest on a desk-top, plate 20 is then supported at a rearwardly inclined position. Step 21 is provided with a raised ridge 23 whose front surface is coplanar with lower plate section 20.

Figure 8:
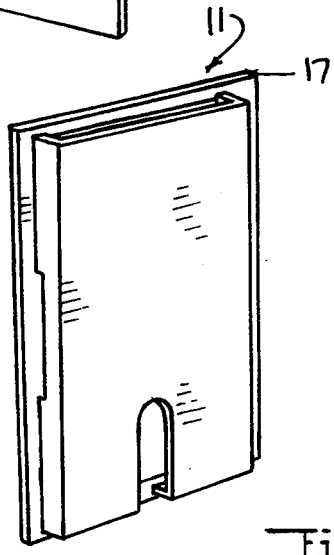
FIG. 8 is a rear view of the pocket.
Figure 9:
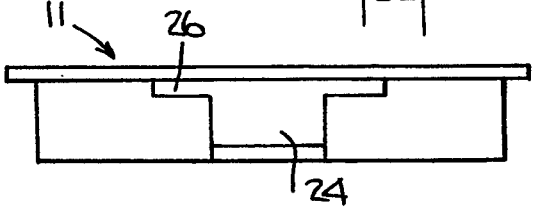
FIG. 9 is a bottom end view of the pocket.

As best seen in FIGS. 8 and 9, pocket 11 is provided at its closed lower end with a larger finger notch 24 which makes it possible to push out from the pocket with a finger the entire deck of cards 12 therein. Before doing so, the frame-pocket assembly, as shown in FIG. 5, must be taken off easel 14.

The print in the deck which is displayed through window 16 is the first in the deck and lies against the window. But if one wishes to change the display to exhibit another print, one must remove the deck from the pocket, select from the deck the next print to be displayed, and place this print at the top of the deck. Then when the deck is reinserted into the pocket, this print will be displayed.

As shown in FIG. 8, a slot 25 is formed in one side of pocket 11, this slot complementing ridge 23 on the easel step. A like slot (not shown) is formed on the opposite side of the pocket. And a complementary slot 26 is formed in the bottom end of pocket 11, as shown in FIG. 9.

Hence one may rest pocket 11 in step 21 so that ridge 23 is socketed in any one of three slots. In this way in the case of slot 26, the frame-pocket assembly will be vertically-oriented, as shown in FIG. 1, and in the case of slot 25, it will be horizontally-oriented to display the picture in its proper orientation. Some of the pictures in the deck are vertically oriented, the others being horizontally oriented; hence the orientation mode in which the assembly is put depends on the orientation of the picture on display.

In practice, all components of the picture gallery may be molded or otherwise fabricated of synthetic plastic material of high strength, such as polyethylene or polypropylene. The color of all components, except for the mat, is preferably black, so that the gallery will fit into any decor. The face mat itself, as previously explained, may be in black or in any other color, and it may have a decorative pattern, for the appearance of the gallery is largely determined by that of the mat, all other components being behind the mat and hence not visible when viewing a picture.

The dimensions of the gallery are appropriate to those of the prints to be displayed, so that instead of being designed to display 4 by 6 inch size prints, it may be designed to display 3 by 5 inch size prints.

While there has been shown and described a preferred embodiment of a desk-top picture gallery in accordance with the invention, it will be appreciated that many changes and modifications may be made therein without, however, departing from the essential spirit thereof.

I claim:

1. A desk-top picture gallery for selectively displaying any picture in a deck of rectangular photo prints all of the same size housed in the gallery, said gallery comprising:

(a) a frame having a rectangular opening whose dimensions are substantially the same as those of the prints housed in the gallery;

(b) a box-like pocket secured to the rear of the frame behind the opening, said pocket having a closed bottom end and an open top end and an open top end accommodating the deck of prints inserted into the pocket through said open top end, and a front window to display through the opening the first print in the deck, said frame and said pocket forming a frame-pocket assembly; and (c) a detachable easel including means for supporting the assembly so that it is either horizontally or vertically oriented to display a first print of like orientation.

2. A gallery as set forth in claim 1, wherein said frame is provided at its front side with a raised border surrounding the opening, further including a removable, rectangular mat that fits onto said raised border and lies against the frame.

3. A gallery as set forth in claim 1, wherein said frame is provided at its rear side with a recessed border surrounding said opening, and said pocket is provided at its front with a rectangular flange that surrounds said window and fits into said recessed border.

4. A gallery as set forth in claim 1, wherein the closed bottom end of the pocket has a finger notch therein to facilitate removal of the deck from the pocket through the open top end.

5. A gallery as set forth in claim 1, wherein said easel includes a back plate that is supported at a rearwardly inclined position, said plate having a step on which the pocket of the assembly rests.

6. A gallery as set forth in claim 5, wherein said step is provided with a ridge that is socketed in a complementary slot in said pocket to support the assembly so that it is either horizontally or vertically oriented.

7. A gallery as set forth in claim 6, wherein said slot is in the bottom end of the pocket, whereby the assembly is then vertically oriented.

8. A gallery as set forth in claim 6, wherein said slot is in a side of the pocket, whereby the assembly is then horizontally oriented.

9. A gallery as set forth in claim 8, wherein said back plate is supported at its lower end on a horizontal rod and is provided with an arcuate leg joined to the rear of the plate at an upper section thereof.

* * * * *